United States Patent [19]

Massa

[11] 4,439,847

[45] Mar. 27, 1984

[54] HIGH EFFICIENCY BROADBAND DIRECTIONAL SONAR TRANSDUCER

[75] Inventor: Frank Massa, Cohasset, Mass.

[73] Assignee: The Stoneleigh Trust, Cohasset, Mass. ; Fred M. Dellorfano, Jr. and Donald P. Massa, trustees

[21] Appl. No.: 332,457

[22] Filed: Dec. 21, 1981

[51] Int. Cl.[3] ..... H04R 17/00

[52] U.S. Cl. ..... 367/151; 310/335; 310/337; 367/155

[58] Field of Search ..... 367/141, 151, 153, 155, 367/156–159, 165, 166, 168, 171, 173, 912; 181/106; 310/335, 337; 73/628

[56] References Cited

U.S. PATENT DOCUMENTS

| | | | |
|---|---|---|---|
| 2,438,925 | 4/1948 | Krantz | 367/168 |
| 2,922,140 | 1/1960 | Levine et al. | 367/151 |
| 3,277,451 | 10/1966 | Parssinen | 367/155 |
| 3,302,163 | 1/1967 | Andrews, Jr. | 367/159 X |
| 3,562,451 | 2/1971 | Mullen, Jr. et al. | 367/165 |
| 3,703,652 | 11/1972 | Noda | 367/151 |
| 4,209,766 | 6/1980 | Teel | 367/155 |

FOREIGN PATENT DOCUMENTS

| | | | |
|---|---|---|---|
| 52-45363 | 4/1977 | Japan | 367/151 |

*Primary Examiner*—Harold J. Tudor

[57] ABSTRACT

A high efficiency wideband underwater transducer utilizes an axial alignment of transducer elements each employing a thin-walled radially vibrating cylinder mounted coaxially within a 45° conical-shaped reflecting annulus. Each transducer element in the array is made progressively smaller in diameter so that the complete structure takes the shape of a pagoda-like assembly that fits compactly within a small size streamlined waterproof housing.

16 Claims, 5 Drawing Figures

HIGH EFFICIENCY BROADBAND DIRECTIONAL SONAR TRANSDUCER

This invention relates to electroacoustic transducers and more specifically with improving the efficiency and extending the bandwidth of an underwater transmitting transducer for operating in the high audio and ultrasonic frequency region between approximately 10 kHz to 100 kHz. It is well known to those skilled in the art that a transducer designed to have an approximately conical directional beam pattern generally utilizes a plane vibratile piston area whose effective diameter exceeds approximately ½ wavelength at the operating frequency. It is also generally well known to those skilled in the art that the bandwidth of an underwater transducer of the vibratile piston type operating at the higher audible or in the ultrasonic frequency region is generally very much less than ½ octave if high operational efficiencies in the order of 40 to 60 percent are required to be met. Therefore to cover a bandwidth in excess of ½ octave or in the order of one or two octaves, it is necessary to employ several separate vibratile piston transducers, each designed to be used over a relatively small part of the wideband operating frequency range.

The disadvantage of using several piston transducers to cover a wide frequency range efficiently is that the transducer size and weight are significantly increased which restricts the use of the transducer for many applications where small size is required. For example, a typical vibratile piston transducer of the type shown in FIG. 7 of U.S. Pat. No. 3,328,751 or FIG. 1 of U.S. Pat. No. 3,319,219 can be designed to operate with an efficiency in the order of 50% over a bandwidth in the order of ¼ octave. Therefore, to achieve an efficient response over a bandwidth in the order of 2 octaves, for example, will require a cluster of approximately 8 separate transducers, each covering about ¼ octave, with the corresponding large increase in total size and weight for the multiple element array.

This invention achieves broadband response at high efficiency with a novel transducer array that occupies a relatively small diameter no larger than the diameter of a single element used in the conventional multi-element piston array above described. The novel array disclosed in this invention employs an axial alignment of a plurality of transducer elements each employing a radially vibrating thin-walled cylinder mounted coaxially within a 45° conical-shaped reflecting annulus. Each transducer element in the array is made progressively smaller in diameter so that the complete structure takes the shape of a pagoda-like assembly that fits compactly within a small size streamlined waterproof housing that can become the nose of a small diameter underwater vehicle.

The primary object of this invention is to design a small size wideband transducer array that will achieve a transmitting efficiency underwater in the order of 50% over a frequency range in excess of ½ octave and as great as one or two octaves or more.

Another object of this invention is to design an underwater transducer array that has high efficiency over a wide frequency band in excess of ½ octave and as great as one or two octaves for operating in the upper audio or ultrasonic frequency region above 5 kHz.

Still another object of this invention is to design an efficient wideband underwater transducer which comprises an array of axially aligned transducer elements each employing a radially vibrating thin-walled cylinder of progressively smaller diameter mounted coaxially within a 45° conical-shaped reflecting annulus. Each transducer element assembly of progressively smaller diameter is displaced axially to form a tapered pagoda-like assembly which is enclosed within a small diameter waterproof streamlined housing structure to permit non-turbulent movement of the structure through the water.

Another object of the invention is to utilize thin-walled ceramic cylinders as the active elements in the above described transducer array and to make the wall thicknesses of the cylinders approximately 5% of their diameters in order to achieve a bandwidth for each element in the array of approximately ⅓ octave or greater.

A further object of the invention is to encapsulate the above described pagoda-like multi-element transducer array within a streamlined molded shape of sound transmitting material to provide efficient acoustic coupling from the vibratile surfaces of the transducer elements to the water within which the transducer assembly is immersed.

A still further object of this invention is to design a broadband high efficiency transducer which comprises a multi-element array of coaxially aligned transducer elements each employing a radially vibrating thin-walled cylinder of progressively smaller diameter and in which the sound radiation is directed primarily along the principal axis of the assembly in a direction generally toward the smaller diameter end of the transducer element array.

Another object of this invention is to design a broadband high efficiency transducer which comprises a multi-element array of concentric thin-walled cylindrical transducer elements with each cylindrical element surrounded by a concentric 45° conical reflecting annulus and the entire assembly of conical reflectors is nested within a common approximate planar surface whereby the multiple concentric annual 45° conical reflecting surfaces lie approximately in the same plane.

This invention contemplates other objects, features and advantages that will become more fully apparent from the following description taken in conjunction with the accompanying drawings which illustrates two preferred embodiments in which.

Figure 2:
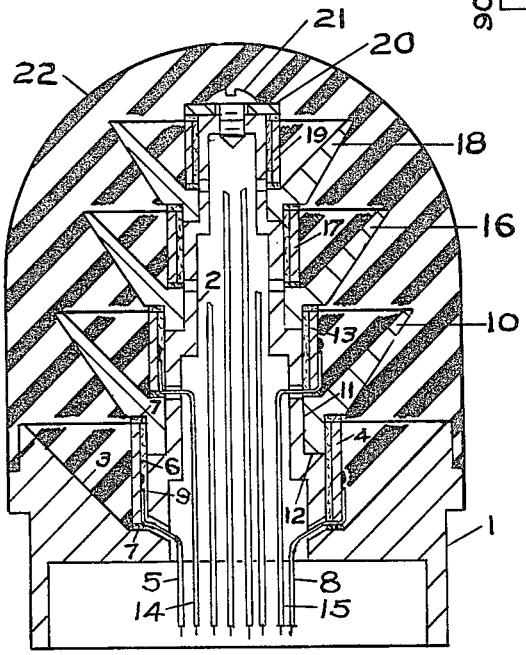
FIG. 2 is a cross section taken along the line 2—2 of FIG. 1.

Referring more specifically to the figures the reference character 1 represents the main support structure for the transducer array which includes the axial cylindrical multi-diameter tubular portion 2 and the 45° conical reflecting portion 3. A thin-walled vibratile cylinder 4, which is preferably a polarized ceramic such as lead zirconate titanate, includes conducting electrodes on the inner and outer wall surfaces as is well known in the art and not shown in the drawing to avoid unnecessary congestion. One end of an insulated wire 5 is soldered to the inner electrode surface of the cylinder 4 as illustrated in FIG. 2 and then a layer of corprene 6 is cemented over the soldered end of the wire and to the inner wall surface of the ceramic cylinder 4 using a suitable adhesive as is well known in the art. A thin washer-like layer of corprene 7 is used to cover both end surfaces of the cylinder 4 as illustrated. One end of an insulated conductor 8 is soldered to the outer electrode surface of the ceramic cylinder 4 as shown. The prepared cylinder 4 is then assembled in place over the outer cylindrical surface 9 of the tubular member 2 while the insulated conductors 5 and 8 are passed through the clearance holes drilled through the wall of the tubular portion 2 of the support structure 1 as shown in FIG. 2. When the cylinder 4 is installed as described, the radial vibrations of the cylinder will be reflected from the 45° conical surface 3 and the sound will be redirected toward the axial direction of the assembly.

A conical-shaped reflector member 10 has an axial clearance hole to fit over the machined cylindrical surface 11 of the tubular member 2 and when it is installed and seated on the shoulder 12 the corprene washers 7 will be compressed slightly to hold the cylinder 4 in operating position in the assembly. A second cylinder 13 which is smaller than cylinder 4 is prepared with attached insulated wires 14 and 15 and with corprene liners similar to what was described in the preparation of the ceramic cylinder 4. The details of the corprene elements associated with cylinder 13 are not indicated by reference characters to avoid cluttering up the drawing. The conductors 14 and 15 are passed through clearance holes drilled through the wall of the tubular support member 2 and the end of the prepared vibratile cylinder 13 is seated to the flat mating surface of part 10 as illustrated in FIG. 2. Next, conical reflector 16 is assembled to the structure in the same manner as described for the assembly of conical reflectors 10 and 13. Then the ceramic cylinder 17 is prepared and assembled in place in the same manner as described for the assembly of ceramic cylinder 13. Finally, conical reflector 18 and ceramic cylinder 19 are assembled in place in the same manner as previously described for reflector 16 and ceramic 17. The details of the wire connections to the vibratile cylindrical elements 17 and 19 are not shown in order to avoid cluttering the drawings by repeating what has been already described and shown in connection with the vibratile cylindrical elements 4 and 13.

Following the assembly of all the elements illustrated in FIG. 2, a retaining washer 20 is securely fastened by means of the screw 21 to the flat end of the tubular member 2 as shown. The dimensions are so chosen that the various corprene gaskets placed over the ends of the several ceramic cylinders are satisfactorily compressed by the desired amount when the screw 21 is secured in place. After completing the structural assembly as described, a sound transparent potting compound 22 such as polyurethane, which preferably has a formulation such that it approximates the characteristic acoustic impedance of water is poured into a mold, not shown, to completely fill all the space between the vibratile walls of the ceramic cylinders and the surrounding concentric 45° conical reflecting surfaces. The potting material is preferably degassed by exposing it to a vacuum prior to pouring it into the mold containing the multi-element array. It is also preferable to evacuate the mold chamber containing the array assembly prior to pouring in the potting compound as is well known in the art of transducer design to avoid the entrapment of air in the potting compound which would prevent the efficient transmission of sound through the material.

The potting compound may be allowed to flow through the clearance holes provided for the insulated wires in the tubular member 2, if desired, so that the potting compound also fills the space inside the tubular member 2. Alternately the holes through the tubular member 2 may be sealed with any suitable sealant such as epoxy or silicone rubber to prevent the potting compound 22 from penetrating into the opening inside the tubular member 2. After the structure of FIG. 2 is potted, the undercut outside diameter of the housing base member 1 may be attached to the inside diameter of a cylindrical tube, for example, whose outside diameter is flush with the diameter of the potted assembly and the transducer assembly will become the streamlined nose of a complete structure which can be propelled through the water with low resistance and negligible turbulence. The conductors from all the ceramic cylinders which are shown together within the rear recess portion of the base member 1 can be appropriately connected to the electronic components which may be provided as desired for operating the transducer.

An alternate more conventional sound transparent housing structure assembly may be used instead of the potted structure 22 if so desired. The alternate arrangement would use a hollow streamlined rubber cap sealed to the periphery of the base member 1 and a sound conducting liquid such as castor oil can be used to fill the space within the attached rubber cap and the enclosed transducer structure. This alternate oil-filled housing assembly is not illustrated in the drawings because it is a very well known conventional construction which has been widely used for many decades in underwater transducer assemblies.

Figure 3:
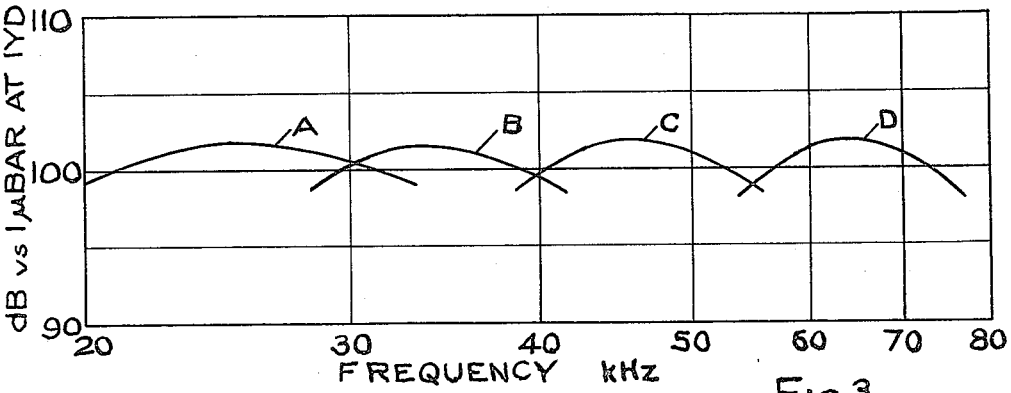
FIG. 3 shows the on-axis response curves for the four-element transducer array illustrated in FIG. 2.

FIG. 3 shows the transmitting response characteristics of the four cylindrical transducer elements assembled in the array illustrated in FIG. 2. Response curves A, B, C and D represent the transmitting response characteristics of the ceramic cylinders 4, 13, 17 and 19 respectively as assembled in FIG. 2. The bandwidth for the ceramic 4 (curve A) is approximately ½ octave because the wall thickness of the larger diameter ceramic cylinder 4 was made less than 5% of the ceramic diameter. Curves B and C both have bandwidths approximately ⅓ octave wide because the wall thicknesses of the ceramic cylinders 13 and 17 were made approximately equal to 5% of the ceramic diameter. The highest frequency cylinder 19 has the response curve D which shows a bandwidth slightly less than ⅓ octave. The reduced bandwidth results from the wall thickness of the ceramic cylinder 19 being slightly greater than 5% of its diameter. The efficiency of the four transducer elements average 50% over their respective operating frequency bands shown in FIG. 3.

Figure 1:
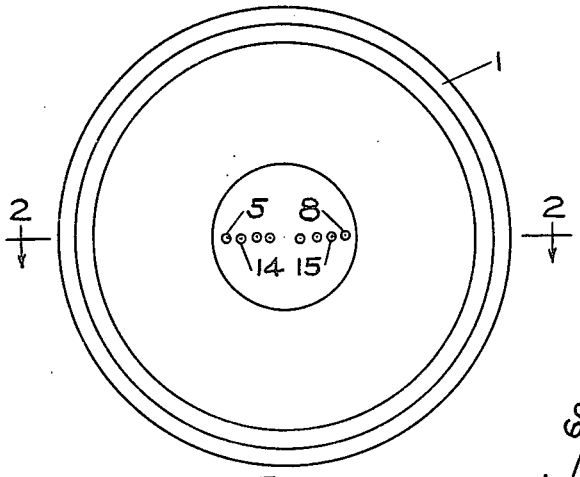
FIG. 1 is a rear view of one preferred embodiment of a high-efficiency wideband transducer incorporating the teachings of this invention.
Figure 4:
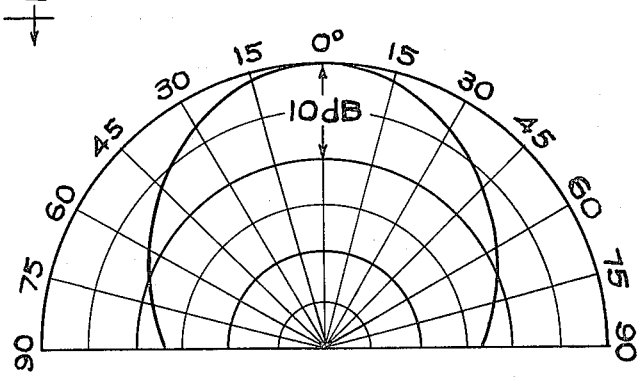
FIG. 4 shows the approximate average beam pattern for each of the elements which make up the transducer array illustrated in FIG. 2.

FIG. 4 shows the average directional pattern as obtained near the center of the frequency band of operation for each of the four transducer elements assembled as illustrated in FIG. 2. The 0° bearing in FIG. 4 is located along the central common axis of the assembly shown in FIG. 2 facing in the direction of the hemispherical end.

Figure 5:
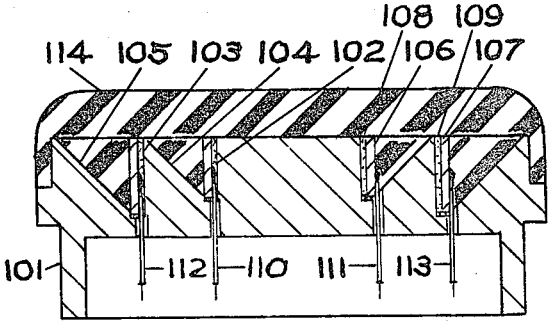
FIG. 5 is a cross-sectional view illustrating another embodiment of the invention in which the concentric array of the cylindrical transducer elements and their concentric surrounding conical reflecting surfaces are all nested within a planar surface of a common housing structure.

FIG. 5 illustrates a cross-sectioned view of an alternate assembly which makes use of the teachings of this invention with a simpler structure than was used in the expanded pagoda-like assembly of FIG. 2. The cylindrical base member 101 has machined into its plane circular face the cylindrical mounting surfaces 102 and 103 and the 45° conical reflecting surfaces 104 and 105. Ceramic cylinders 106 and 107 are lined with corprene 108 and 109. The stripped ends of the insulated conductors 110, 111, 112 and 113 are soldered to the inner and outer electrode surfaces of the ceramic cylinders 106 and 107 as illustrated and as described for the ceramic cylinders in FIG. 2. The assembled cylinders with their attached electrical conductors and corprene liners are placed over the cylindrical mounting surfaces 102 and 103 as illustrated in FIG. 5 and the conductors 110, 111, 112 and 113 pass through holes in the base member 101 as shown. After completing the structural assembly, potting compound 114 is molded in place as illustrated and as described in connection with the molding of potting compound 22 in FIG. 2.

The completed assembly illustrated in FIG. 5 is simpler and lower in cost than the assembly illustrated in FIG. 2; however, the assembly of FIG. 5 cannot be used with as many cylindrical elements as is possible with the pagoda-like expanded axial assembly of FIG. 2 and therefore the planar concentric assembly version of the array structure as illustrated in FIG. 5 may be advantageously applied to arrays having only two or three cylindrical elements. The array structure illustrated in FIG. 2 may be advantageously used when the arrays have three or more cylinders. Either of the array structures illustrated in FIGS. 2 and 5 may be used for arrays having two or three cylinders.

Although a few specific examples have been given to illustrate the advantages of the disclosed invention, it should be understood that additional modifications and alternative constructions may be made without departing from the true spirit and scope of the invention. Therefore, the appended claims are intended to cover all such equivalent alternative constructions that fall within their true spirit and scope.

I claim:

1. In combination in an electroacoustic transducer adapted for high efficiency broadband underwater sound generation in the frequency region above 5 kHz, a support structure including a base portion, a plurality of thin-walled vibratile cylindrical transducer elements of different diameters, a plurality of mounting means associated with said support structure for holding said plurality of cylindrical transducer vibratile elements in axial alignment with relation to said base portion of said support structure, a plurality of conically-shaped sound reflecting surfaces of different diameters, means for locating said plurality of sound reflecting conical surfaces to concentrically surround the vibratile wall surfaces of said plurality of cylindrical transducer elements, a sound conducting waterproof housing structure surrounding and enclosing said plurality of cylindrical transducer elements and said plurality of conical sound reflecting surfaces, and sound conducting means contained within said housing structure for establishing efficient sound transmission between the vibratile surfaces of said cylindrical transducer elements and said conical reflecting surfaces and also between said conical reflecting surfaces and said housing structure.

2. The invention in claim 1 characterized in that the wall thickness of most of said plurality of cylindrical transducer elements is approximately 5% of the diameter.

3. The invention in claim 1 characterized in that said housing structure is a cap-like shell attached to said base portion of said support structure and further characterized in that said sound conducting means fills the space within said cap-like shell.

4. The invention in claim 3 further characterized in that said housing structure and said sound conducting means comprise a single elastomer-like material.

5. The invention in claim 4 further characterized in that the external shape of said elastomer-like material is streamlined about the common axis of alignment of said conical reflecting surfaces.

6. The invention in claim 5 further characterized in that said axial alignment of transducer elements is arranged with the largest diameter structure located closest to the base portion of said support structure, and still further characterized in that the smaller diameter structures are progressively displaced along the common axis of alignment whereby the smallest diameter structure is the farthest removed from the base portion of said support structure.

7. The invention in claim 6 characterized in that the wall thickness of most of said plurality of cylindrical transducer elements is approximately 5% of the diameter.

8. In combination in an electroacoustic transducer adapted for high efficiency broadband underwater sound generation in the frequency region above 5 kHz, a support structure comprising a rigid base portion including a plurality of concentric cylindrical surface portions, a plurality of thin-walled vibratile cylindrical transducer elements, means for supporting said plurality of cylindrical transducer elements on said plurality of concentric cylindrical surface portions whereby said transducer elements remain positioned as sleeve-like coverings over said plurality of concentric cylindrical surfaces, said rigid base portion also including a plurality of concentric conical reflecting surfaces surrounding the vibratile wall surfaces of said plurality of said positioned cylindrical transducer elements, a sound conducting waterproof housing structure surrounding and enclosing said plurality of concentrically mounted transducer elements, and sound conducting means contained within said housing structure for establishing efficient sound transmission between the vibratile surfaces of said cylindrical transducer elements and said conical reflecting surfaces and said housing structure.

9. The invention in claim 8 characterized in that the wall thickness of most of said cylindrical transducer elements is approximately 5% of the diameter.

10. The invention in claim 8 characterized in that said plurality of thin-walled cylindrical transducer elements and said plurality of concentric conical reflecting surfaces which surround said transducer elements are all nested within a common planar surface.

11. The invention in claim 10 further characterized in that said housing structure is a cap-like shell attached to said rigid base portion of said support structure and still further characterized in that said sound conducting means fills the space with said cap-like shell.

12. The invention in claim 11 characterized in that said housing structure and said sound conducting means comprises a single elastomer-like material.

13. The invention in claim 12 further characterized in that the wall thickness of most of said cylindrical transducer elements is approximately 5% of the diameter.

14. In combination in an electroacoustic transducer adapted for high efficiency broadband underwater sound generation in the frequency region above 5 kHz, a support structure comprising a rigid base portion having a longitudinal axis, a plurality of axially aligned cylindrical mounting surfaces of different diameters coaxially displaced along said longitudinal axis and characterized in that the largest diameter cylindrical mounting surface is located closest to said base portion and the smaller diameter cylindrical mounting surfaces are displaced axially such that each progressively smaller diameter mounting surface is progressively spaced farther away from said base portion, a plurality of thin-walled vibratile cylindrical transducer elements or different diameters, means for supporting said plurality of cylindrical transducer elements on said plurality of coaxially displaced cylindrical mounting surfaces whereby said cylindrical transducer elements remain positioned as sleeve-like coverings over said plurality of cylindrical mounting surfaces, a plurality of conical reflecting surfaces of different diameters, mounting means associated with said conical reflecting surfaces for positioning each conical reflecting surface in concentric alignment to surround the vibratile wall surface of its correspondingly sized cylindrical transducer element, a sound conducting waterproof housing structure surrounding and enclosing said plurality of concentrically mounted transducer elements, and sound conducting means contained within said housing structure for establishing efficient sound transmission between the vibratile surfaces of said cylindrical transducer elements and said conical reflecting surfaces.

15. The invention in claim 14 characterized in that the wall thickness of most of said cylindrical transducer elements is approximately 5% of the diameter.

16. The invention in claim 14 characterized in that the transmitting response bandwidth of most of said cylindrical transducer elements is greater than $\frac{1}{3}$ octave.

* * * * *